US007396784B2

(12) United States Patent
Thiriot

(10) Patent No.: US 7,396,784 B2
(45) Date of Patent: Jul. 8, 2008

(54) MULTILAYER LAMINATED SHEET MATERIAL USABLE FOR MAKING PROTECTIVE GARMENTS, IN PARTICULAR FOR FIRE-FIGHTERS

(75) Inventor: Laurent Thiriot, Andolsheim (FR)

(73) Assignee: Kermel, Colmar (FR)

( * ) Notice: Subject to any disclaimer, the term of this patent is extended or adjusted under 35 U.S.C. 154(b) by 0 days.

(21) Appl. No.: 10/494,807

(22) PCT Filed: Nov. 6, 2002

(86) PCT No.: PCT/FR02/03789

§ 371 (c)(1),
(2), (4) Date: May 27, 2004

(87) PCT Pub. No.: WO03/039280

PCT Pub. Date: May 15, 2003

(65) Prior Publication Data

US 2004/0266293 A1 Dec. 30, 2004

(30) Foreign Application Priority Data

Nov. 7, 2001 (FR) ..... 01 14571

(51) Int. Cl.
*D03D 15/04* (2006.01)
*D04H 1/22* (2006.01)
*B32B 27/12* (2006.01)

(52) U.S. Cl. ..... 442/303; 442/203; 442/217; 442/286; 442/301; 442/312; 428/920; 428/921

(58) Field of Classification Search ..... 442/304, 442/203, 217, 286, 301, 303, 312
See application file for complete search history.

(56) References Cited

U.S. PATENT DOCUMENTS

| | | | | |
|---|---|---|---|---|
| 3,063,966 | A | 11/1962 | Kwolek et al. | 260/78 |
| 3,359,610 | A * | 12/1967 | Faircloth | 28/156 |
| 3,837,943 | A * | 9/1974 | Ploch et al. | 156/93 |
| 6,277,469 | B1 * | 8/2001 | Wildeman | 428/167 |
| 2003/0003264 | A1 * | 1/2003 | Rock et al. | 428/92 |

FOREIGN PATENT DOCUMENTS

| | | |
|---|---|---|
| FR | 1213415 | 3/1960 |
| WO | WO 97/42026 | 11/1997 |
| WO | WO 99/05926 | 2/1999 |
| WO | WO 00/00051 | 1/2000 |

* cited by examiner

*Primary Examiner*—Jenna-Leigh Johnson
(74) *Attorney, Agent, or Firm*—Weingarten, Schurgin, Gagnebin & Lebovici LLP

(57) ABSTRACT

This material is remarkable in that it is made by weaving or knitting, in such a manner as to form a structure comprising two superposed faces (1, 2) intermittently interconnected to each other so as to form pockets, and in which:

one of the layers shrinks under the effect of heat; and the linking between the layers is implemented by intermittently linking selected yarns so as to form said pockets.

7 Claims, 5 Drawing Sheets double woven fabric

MULTILAYER LAMINATED SHEET MATERIAL USABLE FOR MAKING PROTECTIVE GARMENTS, IN PARTICULAR FOR FIRE-FIGHTERS

This application is a 371 national phase filing of PCT/FR02/03789 filed Nov. 6, 2002, and claims priority to a French application No. 01 14571 filed Nov. 7, 2001.

TECHNICAL FIELD

The present invention relates to cloth in sheet form for making protective garments, in particular working jackets for people in danger of being subjected to extreme conditions, in particular in the event of a fire.

The invention relates in particular to a novel type of material suitable for making garments for firefighters, although other applications are not excluded.

PRIOR ART

In the description below, the invention is described for a particular application, namely that of making working jackets for firefighters.

It is clear that this application is not limiting and that such a material could be used in other applications, whenever extreme conditions are present, e.g. during a fire.

At present, in order to make working jackets, multilayer structures are used, which, as a general rule, and as can be seen in accompanying FIG. 1, are made up in general of four elements:

an outer fabric (A);

a waterproof and breathing membrane, generally associated with a substrate (B);

a thermal barrier generally constituted by a needled felt (C); and a finishing lining (D).

The making of such laminated materials suitable for use under extreme conditions is well know to the person skilled in the art and can be found in particular in French patent No. 1 213 415.

Such structures have subsequently evolved by making use in particular of textile materials that withstand heat and fire, based on aromatic polyamides or on polyamide imide.

Amongst the better-known synthetic materials of this kind, mention can be made in the aromatic polyamide family of para-aramid fibers or yarns, such as those sold by the supplier Du Pont de Nemours under the name "Kevlar" or by the supplier Teijin under the trademark "Twaron" and "Technora". Such polymers which may be in the form of fibers, yarns, or other structures, constitute the subject matter of numerous publications, amongst which mention can be made of U.S. Pat. No. 3,063,966.

Amongst materials that also withstand heat, and which form part of the meta-aramid family, mention can be made of the polymer sold by the supplier Kermel under its own name, the fibers sold under the trademark "Nomex" by the supplier Du Pont de Nemours, and those sold under the trademark "Conex" by the supplier Teijin.

As mentioned above, the invention thus relates to the field of making multilayer materials of the kind shown in FIG. 1.

In such materials, a problem arises concerning the thermal barrier which is generally constituted by a needled felt, and the finishing lining which is situated on the user side thereof.

The laminates that have been proposed until now suffer from a drawback which lies essentially in the fact that the garments made from them are uncomfortable both physically and physiologically.

In addition, under certain circumstances, they are lacking in effectiveness.

It has been reported that about 50% of the causes of firefighter death in the Untied States are the consequence of a phenomenon that is well known in the field by the term "heat stress", which is a state in which the body can no longer maintain a temperature below 39° C., and which leads to various disorders, which in addition to a loss of physical ability, can include loss of lucidity, fainting, or even cardiac arrest.

Such a stress state is caused in particular by the weight of the equipment carried which can exceed 20 kilograms (kg) and by the insulating ability of the protective garments which can sometimes be excessive.

SUMMARY OF THE INVENTION

It has been found, and this constitutes the subject matter of the present invention, that it is possible to solve this problem by making a novel type of material for prior art laminated structures of the type shown in FIG. 1, which material serves to provide a thermal barrier function, and preferably also a finishing lining.

This new type of laminate, referred to herein by the term "thermal barrier", provides moderate insulation under normal circumstances because it is thin and presents small heat load, thereby improving comfort, and as a function of increasing temperature, it also makes it possible to increase insulation, with such an increase possibly being localized in those zones where heat is greatest when the user is confronted with an emergency situation by a fire.

In general, such a possibility is obtained with the material of the invention by making a laminate that performs simultaneously the thermal barrier and the finishing lining functions, by making use of a technique for making woven cloth, which technique produces "pockets" or bonded double cloth.

Such technology consists in making two (or more) fabrics in a single operation, which fabrics are distinct and superposed and are interconnected by selecting yarns (warp or weft) which are engaged in alternation in a predetermined selection with one and with the other of the weaves of the two superposed fabrics.

By way of indication, a warp yarn of the top face may, in a predetermined sequence, be linked with a warp (or pick) yarn of the bottom face. This linking may be implemented using any type of pattern, and is conventionally used for forming lozenges or tubes.

In general, in the state of the art, the back and front faces of different colors are reversed to obtain a decorative effect, which is not desirable in the context of the invention where each face needs to have a specific function.

Such double-faced structures may optionally also be made by knitting, either using the sunk loop technique or the reinforcing loop technique, more particularly on a Raschel or a warp type knitting machine.

In general, and given the problem posed of providing a thermal barrier for providing protection, in particular in the garments of firefighters, with the purpose of improving the comfort of such garments both physically and physiologically, the invention provides a multilayer laminated sheet material for providing a thermal barrier that is made up of a first layer and a second layer, the material being characterized in that it is made by weaving or knitting, in such a manner as to form a structure comprising two superposed faces intermittently interconnected to each other so as to form pockets, and in which:

one of the layers shrinks under the effect of heat; and the linking between the layers is implemented by intermittently linking selected yarns so as to form said pockets.

Advantageously, the layer that shrinks under the effect of heat is constituted completely or in part by yarn that shrinks under said effects of heat.

In a preferred embodiment, the pockets constitute channels, with shrinking under the effect of heat taking place only in the family of yarns that extend perpendicularly to said channels, considered in full or in part.

Without going beyond the ambit of the invention, the shrinking effect of the thermal barrier layer in question can result from the presence of a membrane that is fixed to said layer, or from a coating.

BRIEF DESCRIPTION OF THE DRAWINGS

The invention and the advantages it provides will be better understood on reading the following description of an example of a laminate in accordance with the invention, and as shown in the accompanying diagrams, in which.

Figure 2:
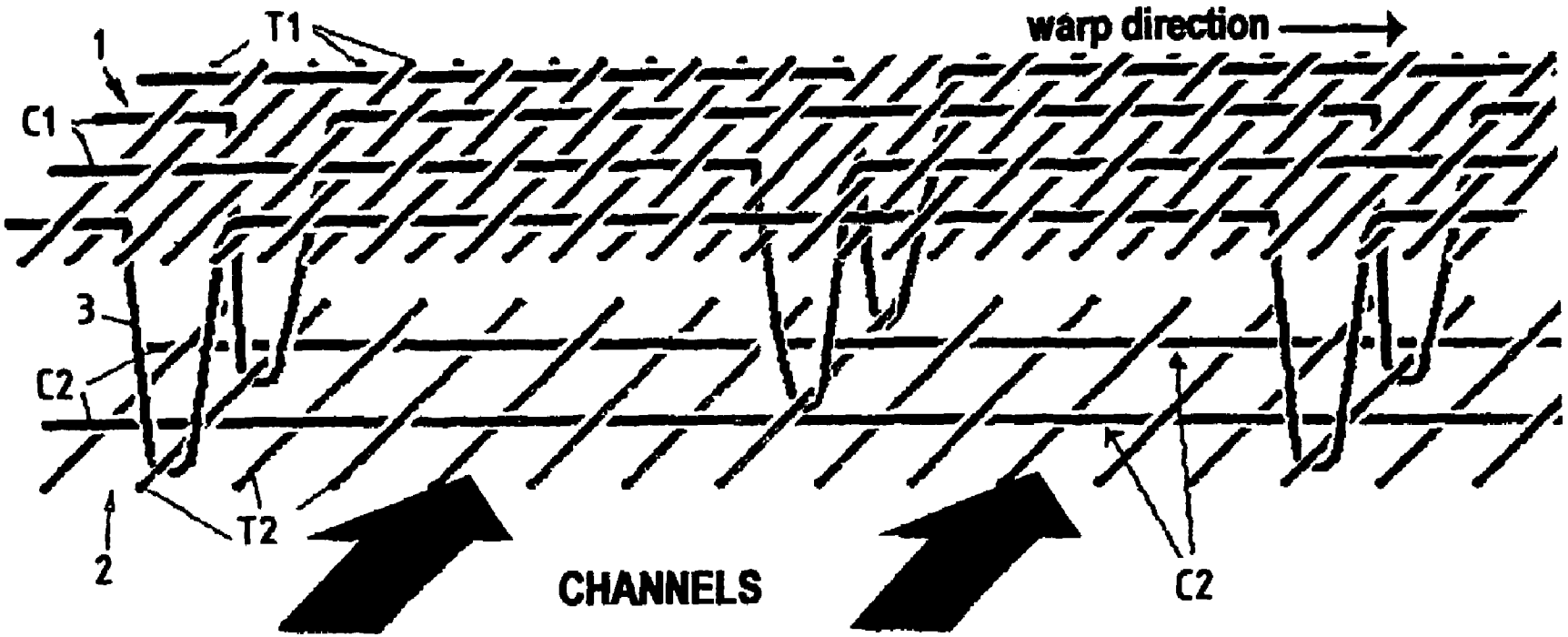
FIG. 2 is a perspective diagram showing an example of a structure for a laminate enabling the thermal barrier and the finishing lining present in the above-mentioned laminate to be made simultaneously.
Figure 3:
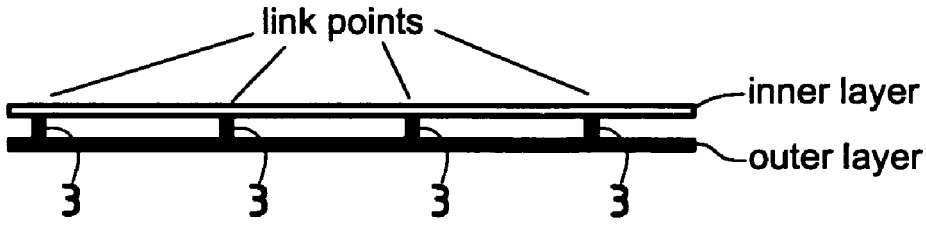
FIG. 3 is a diagrammatic section view of a material in accordance with the invention when the user is in normal working conditions.

With reference to accompanying FIGS. 2 and 3, the basic structure in accordance with the invention is thus constituted by a pocket fabric comprising an inner layer given overall reference (1) and an outer layer given an overall reference (2), these two layers being disposed next to each other and being linked together intermittently by selected warp yarns (3), which yarns are selected from those that constitute the inner layer.

In other words, in such a structure, the linking lines (3) form between them pockets that are flat and that extend between the inner layer (1) and the outer layer (2).

In this example, and as can be seen more particularly in FIG. 2, the warp yarns (C1) that are for making the inner layer (1) on the lining side, and the weft yarns (T1) are both constituted by yarns, and more particularly by spun yarns, of fibers that present practically no ability to shrink under the effect of intense heat.

The warp yarns (C2) for constituting the outer layer (2) are made of yarns that do indeed present some small ability to shrink compared with the yarns (C1). However, the weft yarns (T2) for constituting the outer layer are likewise based on spun yarns that present no ability to shrink.

In the specific example shown in FIG. 2, the density of warp yarns (C2) and of weft yarns (T2) is half that of the warp yarns (C1) and of the weft yarns (T1) of the other face.

Figure 4:
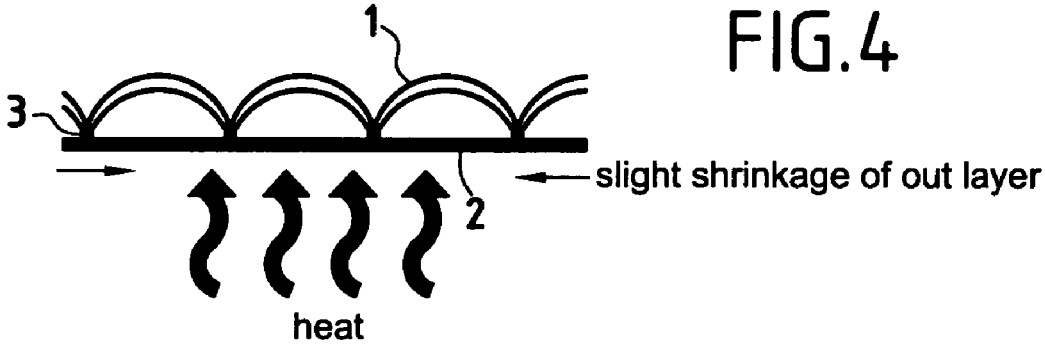
FIGS. 4 and 5 are a section view and a perspective view in diagrammatic form showing how the laminate of the invention changes when the user is confronted with a sudden change in working conditions, and more particularly a sudden increase in heat.
Figure 5:
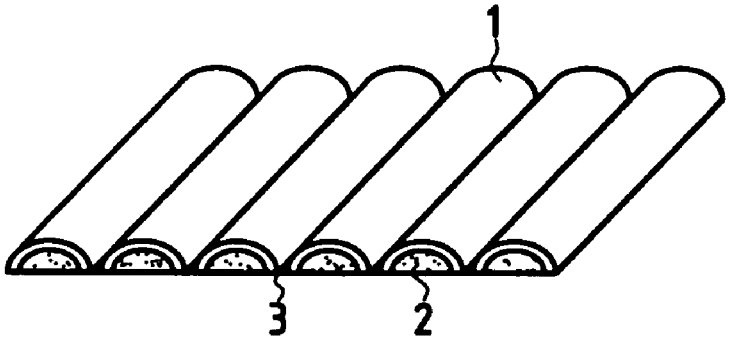

By means of such a structure, the fact of using yarns in the outer layer that shrink a little when heated, makes it possible to obtain a reaction in the presence of heat of the kind shown in FIG. 4.

When the temperature reached by the outer layer (2) is high, e.g. when the warp yarns are made of meta-aramid yarns such as, for example: isostalamides and polyaramides, is a temperature of about 300° C., then the outer warp (C2) shrinks, thereby drawing together the generator lines (3) defining the linkage zones. Since the layer (1) is dimensionally stable when heated, and since it is also protected in part by the outer layer, this leads to the inside being relaxed, and thus to pockets being formed in relief.

It should be observed that even if (C1) and/or (T1) were made of materials that present the ability to shrink, the fact that they are protected in part by the face (2) would still create a temperature difference between the two faces and would thus lead to a shrinkage difference that would create pockets in relief.

These spaces increase with increasing temperature, thereby increasing the thickness of the laminate and trapping air, thereby increasing the insulating ability of the material.

EXAMPLE

Figure 6:
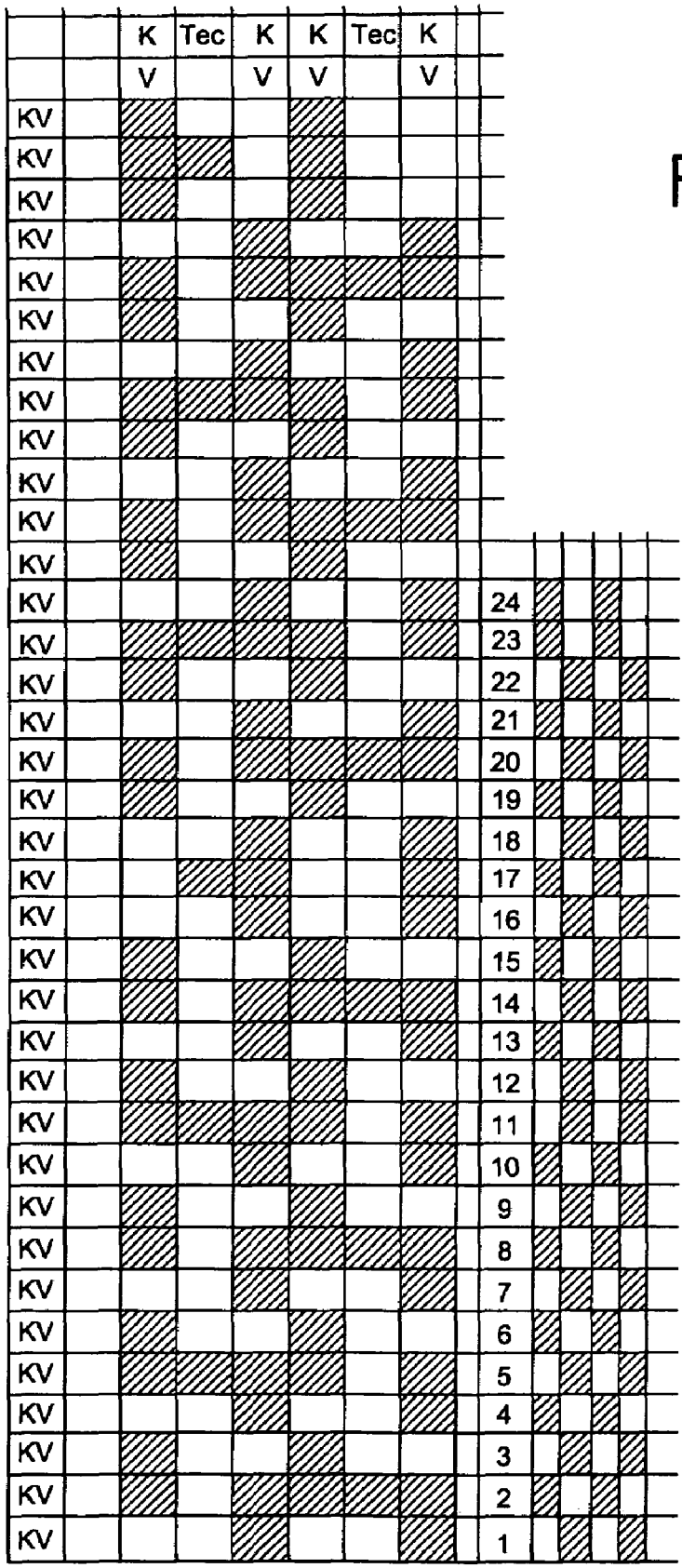
FIG. 6 is a conventional diagram showing, on the left, a double-faced cloth in accordance with the invention and, on the right, the fabric obtained on the front face (the lining face)
Figure 7:
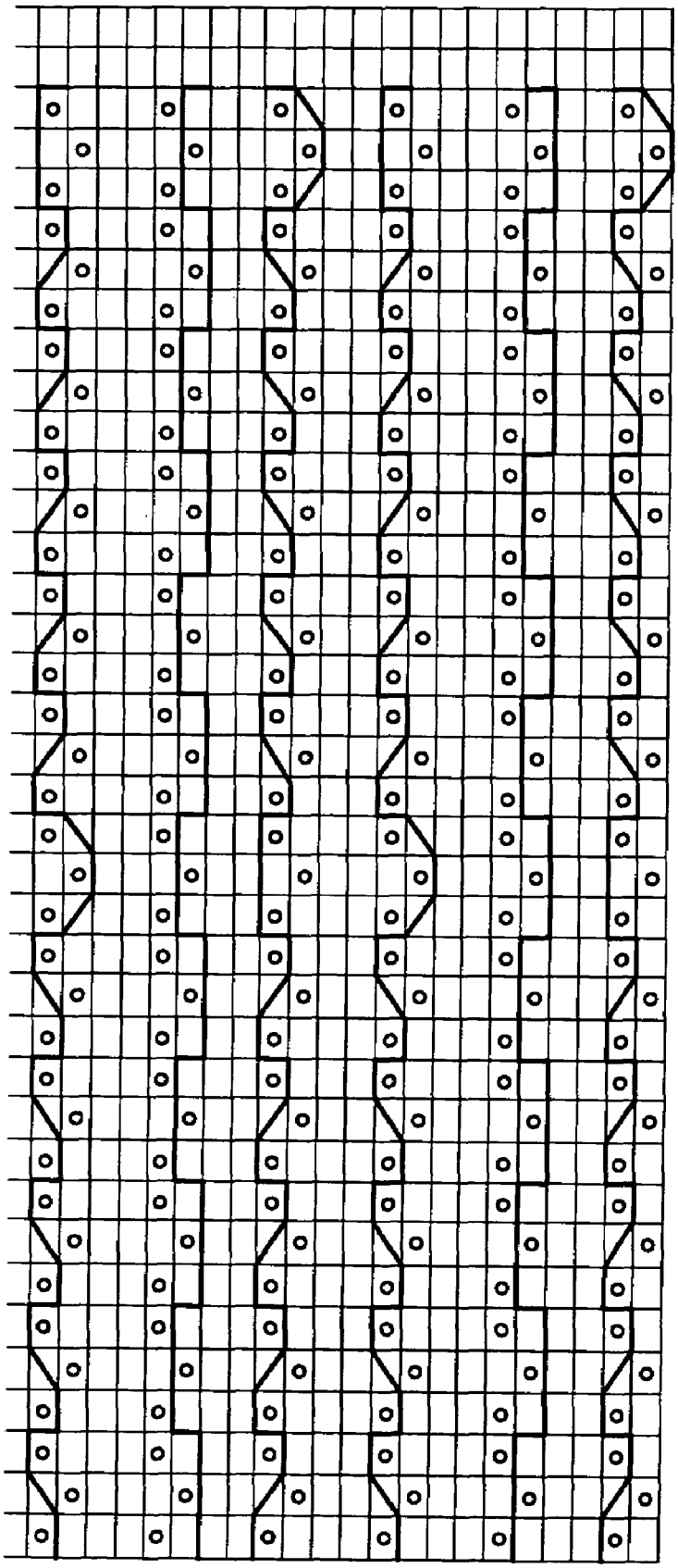
FIG. 7 is a conventional diagram in section view in the warp direction showing how the sheets of warp yarns are disposed relative to the weft yarns in order to constitute a pocket type double-faced fabric, with the faces being linked to each other in a predetermined sequence.

A laminate in accordance with the invention and of the type shown in FIG. 2 was made using the weave that is illustrated in FIG. 6.

The warp (C1) for forming the face that faces towards the user, and the weft (T1) likewise intended for forming said face, were made from a spun yarn of a mixture of fibers comprising polyamide imide fibers (Kermel) and viscose FR fibers (containing a fireproofing agent), in a 70/30 mixture, with the weight of these yarns being equal to Nm 70/2.

This fabric face comprises 26 yarns/cm and 24 picks/cm.

The warp (C2) having the heat-shrinkability and constituting the insulating layer was made of a spun yarn comprising 100% polyamide imide fibers sold under the trade name Kermel Tech, with the weight of this yarn being Nm 60/2.

The density of the warp (C2) was 13 yarns/cm.

The weft (T2) was identical to the inner weft and its density was 12 picks/cm.

On leaving the loom, the weight per unit area of the laminated cloth was about 230 grams per square meter (g/m$^2$).

The inner face (1) with greater structure is suitable for acting as a lining, and is the face that is directed towards the user. The face (2) made of heat-shrink yarns in its warp is the face that acts as a thermal barrier.

Naturally, the embodiment described and shown of the multilayer laminated material of the invention should not be considered as being limiting. The invention relates to any multilayer laminated material in sheet form serving to make a thermal barrier comprising first and second layers by means of a structure comprising two superposed faces interconnected intermittently so as to form pockets. The linking between the layers is obtained by intermittent linking using selected yarns.

One of the layers shrinks under the effect of heat. In the example shown, this shrinkage is obtained over all or part of the link yarns constituting the pockets.

This effect of one of the layers shrinking can also be the result of a membrane being fixed on the layer in question. For example, the membrane may be made out of any material liable to shrink under the effect of heat, such as microporous polyethylene, hydrophilic polyurethane, hydrophilic polyester, . . . .

The laminated material layer in question may optionally be subjected to a coating operation, e.g. being coated in a substance based on polyurethane, on polyvinyl chloride (PVC), on silicone, . . . , in order to create the desired effect of shrinkage under the effect of heat.

After subjecting such a laminated material to testing of its ability to provide protection against radiant heat in application of standard EN 366 and to provide protection against convective heat in application of standard EN 367, it has been found that its protection values are high. In addition, the difference between the theoretical burn times (t2 or HTI 24) and the theoretical pain times (t1 or HTI 12) is improved.

It is found that these values are indeed greater than the average generally observed for prior art laminates.

In addition, this result is obtained using a material that is much more flexible and that presents much smaller heat load in normal operation.

The advantages can clearly be seen from the description. A material is obtained that is much more flexible and comfortable, both physically and physiologically, compared with prior art laminates.

The ability to perceive danger is also improved because this type of laminate adapts the degree of insulation it provides progressively as a function of the level of thermal danger.

It may be added that this laminate does not present the aging problems associated with conventional needled felts (fiber migration, compacting, . . . ), nor does it present the abrasion problems to which thermal barriers presenting permanent relief are subjected or create.

In addition, this novel thermal barrier makes it possible to see the degradation state of the laminate. Since shrinkage takes place only under extreme conditions, it corresponds to a loss of effectiveness of the outer fabric, and above all of the membrane which is generally associated therewith in this type of garment.

When the pockets in the double cloth of the invention are in the form of channels, they are preferably disposed vertically in the garments so as to ensure that the small amount of shrinkage in the perpendicular direction does not raise the bottom of the jacket and the cuffs of the sleeves. This small amount of shrinkage in the layer in question on the body of the wearer is not a problem since it leads to a redistribution of the protective air contained inside the garment, leading automatically to enhanced protection at those locations where spot temperatures are the greatest.

Figure 1:
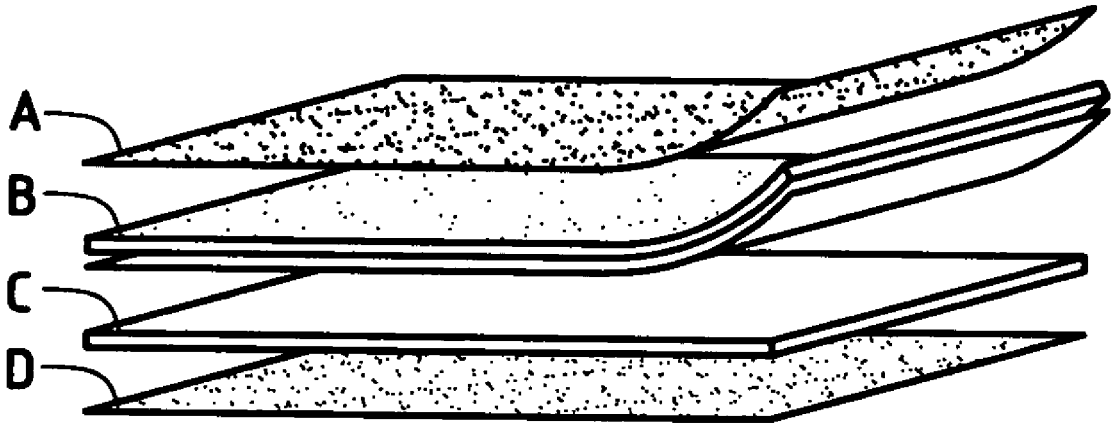
FIG. 1, as described above, shows a conventional multilayer laminate as used at present for making garments for personnel who take action under dangerous conditions, and in particular garments for firefighters.

Naturally, the multilayer laminated material of the invention can advantageously be combined with a structure that also includes an outer fabric and an internal breathing membrane generally associated with a substrate and complying with the general dispositions shown in FIG. 1.

The invention claimed is:

1. A multi-layer laminated sheet material, for a thermal barrier in making protective garments, the sheet material being woven or knitted, comprising:

at least a first layer and a second layer superposed and intermittently linked to each other by selected yarns so as to form pockets between the first and second layers, the first layer and the second layer comprised of one or more fire resistant materials;

wherein the pockets are flat in normal use, and wherein the second layer is comprised of a material that shrinks under the effect of heat more than the first layer in order that under the effect of a high temperature of about 300° C. and of the shrinkage difference between the two layers, the pockets project in relief, increasing the insulating ability of the material against the high temperature.

2. A laminated material according to claim 1, wherein the second layer that shrinks under the effect of heat is constituted completely or in part by yarn that shrinks under said effect of heat.

3. A laminated material according to claim 1, wherein the pockets constitute channels, with shrinking under the effect of heat taking place only in the yarns that extend perpendicularly to said channels.

4. A laminated material according to claim 1, wherein the shrinking effect of the second layer is the result of the presence of a membrane fixed on said layer, said membrane being made of a material which is suitable for causing it to shrink under the effect of heat.

5. A laminated material according to claim 1, wherein the shrinking effect of the second layer is the result of the presence of a coating on said layer of a material suitable for shrinking under the effect of heat.

6. A laminated material according to claim 1, the first layer comprising warp and weft yarns and the second layer comprising warp and waft yarns, wherein the structure ratio between the density of warp and weft yarns of the second layer and the density of the warp and weft yarns of the first layer lies in the range one-to-one to one-to-ten.

7. A protective garment according to claims 1, 2, 3, 4, 5, or 6, wherein the laminated material is combined with a substrate, a breathing membrane and an outer fabric, in that order.

* * * * *